US005934459A

United States Patent [19]

Winsell

[11] Patent Number: 5,934,459

[45] Date of Patent: Aug. 10, 1999

[54] NON-CORROSIVE FLEXIBLE STORAGE POUCH WITH RESERVOIR BOTTOM FOR STORING A SHAVING RAZOR

[75] Inventor: Dennis Winsell, Rancho Palos Verdes, Calif.

[73] Assignee: Razorguard, Inc., Rolling Hills Estates, Calif.

[21] Appl. No.: 08/965,726

[22] Filed: Nov. 7, 1997

[51] Int. Cl.[6] ..... B65D 81/24; A45C 11/26

[52] U.S. Cl. ..... 206/208; 206/352; 206/353; 206/484; 383/38; 383/100

[58] Field of Search ..... 206/208, 352, 206/353, 354, 484; 383/11, 38, 107, 100, 101

[56] References Cited

U.S. PATENT DOCUMENTS

| | | | |
|---|---|---|---|
| 1,189,118 | 6/1916 | Jonas . | |
| 1,912,627 | 6/1933 | Dyer . | |
| 1,963,563 | 6/1934 | Slepicka . | |
| 1,981,853 | 11/1934 | Bruce . | |
| 2,027,899 | 1/1936 | Bruce | 206/208 |
| 2,138,708 | 11/1938 | Peterson | 206/354 |
| 2,177,815 | 10/1939 | Strock . | |
| 2,443,495 | 6/1948 | De Tuesta . | |
| 2,449,818 | 9/1948 | Olsen . | |
| 2,551,859 | 5/1951 | Thompson . | |
| 2,853,085 | 9/1958 | Torkelson . | |
| 3,019,494 | 2/1962 | Horie et al. . | |
| 3,159,096 | 12/1964 | Tocker | 383/906 |
| 3,282,411 | 11/1966 | Jardine | 383/107 |
| 3,352,630 | 11/1967 | Fischer et al. . | |
| 3,759,594 | 9/1973 | Cobb . | |
| 4,418,733 | 12/1983 | Kallman | 383/11 |
| 4,954,337 | 9/1990 | Gripp et al. . | |
| 4,957,732 | 9/1990 | Grollier et al. . | |
| 4,974,319 | 12/1990 | Maguire, Jr. et al. . | |
| 5,007,533 | 4/1991 | Purohit . | |
| 5,251,752 | 10/1993 | Purohit | 206/352 |
| 5,373,966 | 12/1994 | O'Reilly et al. | 206/484 |
| 5,380,093 | 1/1995 | Goldman | 383/906 |

FOREIGN PATENT DOCUMENTS

| | | | |
|---|---|---|---|
| 405278751 | 10/1993 | Japan | 383/906 |
| 275422 | 8/1927 | United Kingdom . | |
| 294274 | 7/1928 | United Kingdom . | |

*Primary Examiner*—Paul T. Sewell
*Assistant Examiner*—J. Mohandesi
*Attorney, Agent, or Firm*—Lyon & Lyon LLP

[57] ABSTRACT

The present invention provides a non-corrosive flexible storage pouch with reservoir bottom for storing a razor, and its method of use. The flexible storage pouch contains a skin conditioner and oil solution that is lighter than water. During use of the pouch, a razor is submerged into the conditioner and oil mixture. The razor rests on support structures within the pouch. Water and debris from the razor settle to the bottom of the pouch and are removed from contact with the razor. Storage of the razor reduces the corrosive effect of water on a razor and helps prevent the bonding of debris to the razor, enhancing the life span of the razor. The conditioner in the pouch moisturizes the skin during shaving.

18 Claims, 2 Drawing Sheets

NON-CORROSIVE FLEXIBLE STORAGE POUCH WITH RESERVOIR BOTTOM FOR STORING A SHAVING RAZOR

FIELD OF THE INVENTION

This invention is in the field of razors and razor blade protection. More particularly, the invention relates to a cleaning and storage device for razor blades, and the method of using the device.

BACKGROUND OF THE INVENTION

A large industry has built up around men and women's desire to remove unwanted facial and body hair. While electric razors are a relatively recent tool for men to remove facial hair, many men continue to rely on disposable razors or razors with disposable razor blades for facial hair removal due to the perceived inability of electric shavers to provide a close shave. Although women have additional hair removal methods at their disposal (e.g., foam that chemically removes hair or wax that mechanically removes hair), they still rely on disposable razors or disposable razor blades. Most recently, lasers have been used to limit or stop follicle hair growth. This method, however, is currently expensive and not used by most consumers. As such, disposable razors and razor blades continue to be the device of choice for hair removal.

Limitations on the use of razors include the short life span of the razor blade, lack of suitable storage mechanisms and the cost involved in the continual purchase of new disposable razors and razor blades.

During shaving, the shaver must frequently rinse the blade with water. After shaving is completed, the razor is typically set aside on a shelf or bathtub surface while debris, such as residual hair and water is left on the blade until the blade is reused. Continual contact with water between uses causes the razor blade to corrode, reducing the blades usefulness and life span. Additionally, debris left on the blade becomes bonded to the razor blade. The adhesion of debris to the blade lessens the sharpness of the razor blade, further reducing the efficiency and life span of the razor. Depending on the shaver's tolerance to pain when using corroded blades or blades compacted with debris, the disposal rate of the razors or razor blades can be very high.

Disposable razors and razor blades are also limited in their ability to moisturize the skin during use. Shaving without the skin being moisturized results in increased nicks and cuts of the skin. These painful nicks and cuts are enhanced in individuals with sensitive skin. While some of the more expensive disposable razors contain a moisturizing strip, after repeated use these strips become ineffective and lead to premature disposal of the blade. Alternatively, to obtain moisturizing of the skin during shaving, a cream that contains a skin conditioner must be applied.

SUMMARY OF THE INVENTION

To these ends, the present invention provides a device and method to clean and store razors and razor blades so as to remove water and hair from the blade after shaving, thus increasing the life span of the razor. The present invention also provides a device and method for moisturizing the surface of the skin during shaving.

In a preferred embodiment, a razor is stored in a flexible pouch with a reservoir bottom containing a skin conditioner and oil solution that is lighter than water. Storage in this medium removes water and debris (e.g. residual hair) from the razor blade, reducing corrosion and buildup of debris on the blade, thus extending the life of the blade. Additionally, the conditioner helps to moisturize the skin when the razor is reused.

The pouch is advantageously made from a flexible material, preferably, in a rectangular shape. Heat seals around the edges of the pouch act to contain the conditioner and oil solution. The pouch also contains heat seals at the base of the pouch thereby forming a reservoir bottom that acts as a support structure for razors inserted into the pouch. When inserted into the pouch, the razor rests on the heat seal support structure while submersed in the conditioner and oil solution. Because the water on the blade is heavier than the conditioner and oil solution in the flexible pouch, it settles to the bottom of the pouch below the razor thereby removing the corrosive water from contact with the razor. Debris from the razor also settles to the reservoir bottom of the pouch.

In a preferred embodiment, the pouch is made of a transparent material to view the conditioner and oil level as well as the water level in the pouch. The pouch may alternatively have a transparent viewing window. The transparent pouch or viewing window helps to alert the user as to when the pouch solution needs to be replaced. Preferably, the pouch includes a pouch support structure to connect the flexible pouch to a wall or mirror or, alternatively, support the pouch in a freestanding upright position.

DETAILED DESCRIPTION

Figure 1:
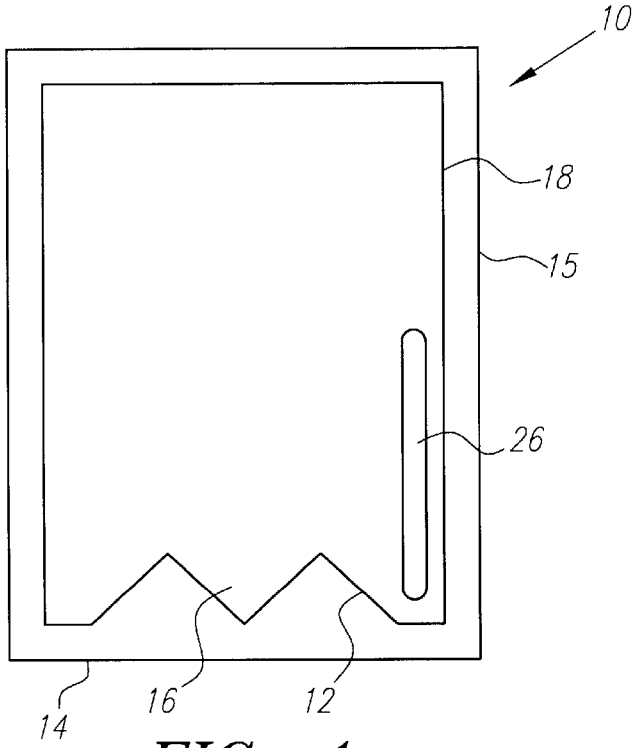
FIG. 1 shows a front view of a pouch with two triangular heat seals creating a reservoir bottom for razor support.

Referring now to the drawings, as shown in FIG. 1, a pouch 10 contains a skin conditioner and oil solution 11 that is lighter than water, although any solution that retards corrosion and that is lighter than water may be used. Preferably, the pouch 10 may be made of any substantially liquid impervious material such as foil or plastic. The pouch 10 should be flexible. The pouch 10 contains bumps in its base 14 so as to form a reservoir bottom 16 to separate water and oil, as well as debris from the blade, such as shaving residue. According to the invention, any water left on the blade after shaving goes down into the reservoir bottom 16, so that it does not contact the blade. This avoids the corrosive effect of water on a blade.

In a preferred embodiment, the reservoir bottom 16 is created integrally from the pouch 10 itself by forming a heat seal 12, 20, or 22 from a heat sealable material at the base of the pouch 10. The reservoir bottom heat seal is a continuation of the side seal 18 and is formed in such a way as to allow water and debris to fall to the reservoir bottom 16 of the pouch, while still providing enough support to keep a shaving razor from contacting the residue and water.

Figure 2:
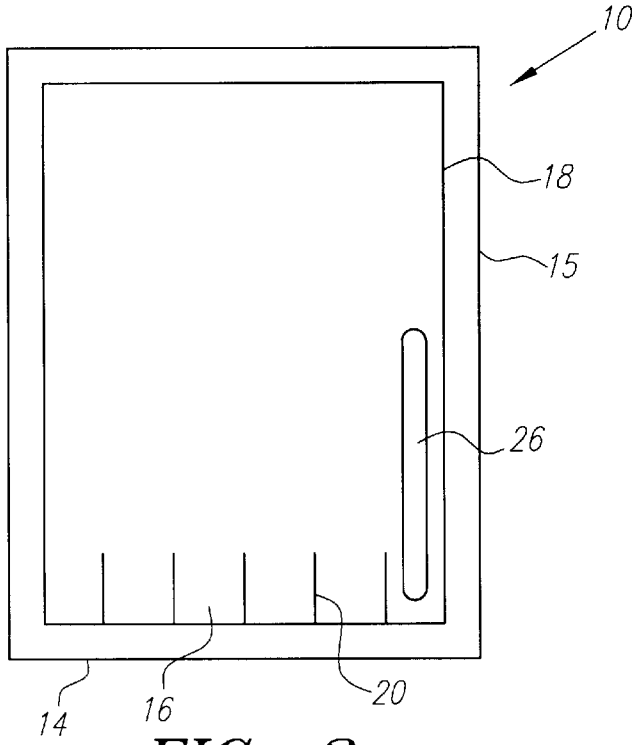
FIG. 2 shows a front view of a pouch with five vertical line heat seals creating a reservoir bottom for razor support.
Figure 3:
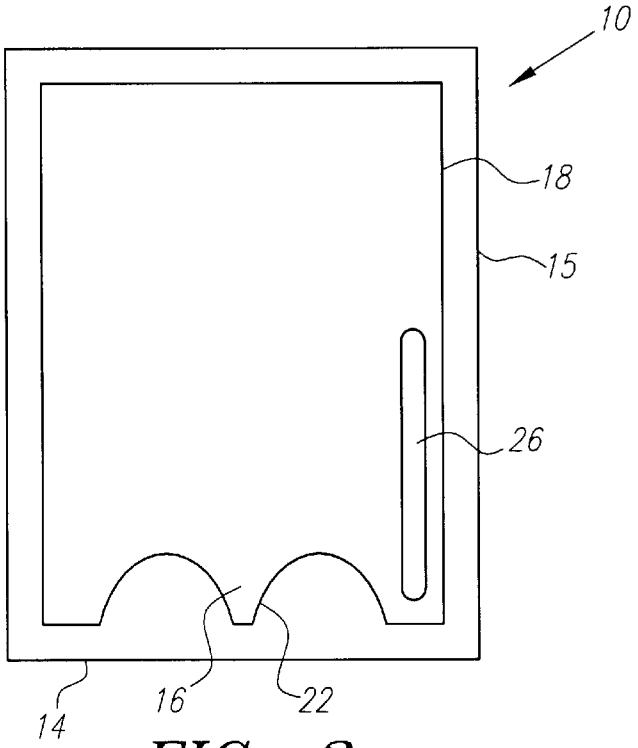
FIG. 3 shows a front view of a pouch with two half-circle heat seals creating a reservoir bottom for razor support.
Figure 4:
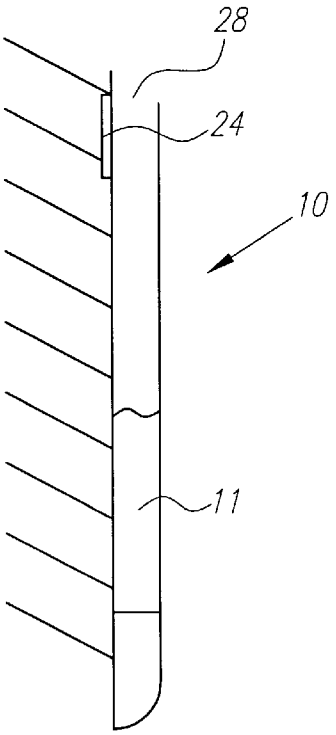
FIG. 4 shows a side view a pouch in use.
Figure 5:
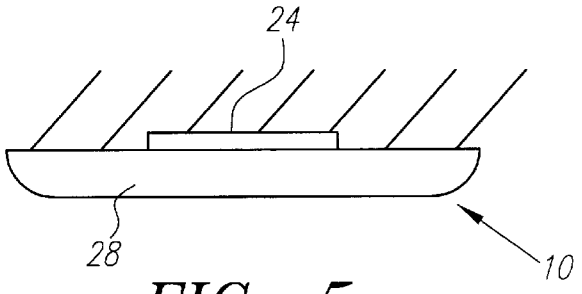
FIG. 5 shows a top view of a pouch in use.

Many configurations of reservoir seals can be used, such as vertical line seals 20, as shown in FIG. 2, or circular seals 22, as shown in FIG. 3. However, most preferably two triangular heat seals 12, as shown in FIG. 1, are used. The reservoir bottom 16 plays the dual role of reducing the amount of conditioner and oil solution 11 that needs to be used as well as providing a mechanism to lift the blade above corrosive agents (e.g. water) that are left on the blade after shaving and that settle to the base 14 of the pouch 10.

The pouch 10 is flexible so as to provide portability and convenience. In a preferred embodiment the flexible pouch is made from inexpensive disposable materials. Preferably, the pouch 10 is made using polypropylene, polyethylene and/or metallic polypropylene. Alternatively, polyethylene foil can be used in place of metallic polypropylene. The pouch 10, in a particularly preferred embodiment has a support structure 24 that consists of an adhesive strip such that the flexible pouch 10 adheres to a mirror or wall. The adhesive strip may comprise an adhesive compound applied directly to the pouch. In a preferred embodiment the adhesive strip is covered with a removable backing material prior to use. In lieu of an adhesive strip, the pouch 10 can be attached to a supporting wall by a magnetic strip, Velcro strip, or tape. This type of support feature reduces space needed for storage of the pouch 10 while providing a stable and convenient platform to store and condition used razor blades. However, the adhesive must provide enough contact with the wall to provide stable support for the pouch 10 when containing a razor blade.

The flexible pouch 10 with integral reservoir bottom 16 feature also results in the advantage that large numbers of the pouches may be shipped while requiring minimal space. The pouch 10 is also preferably light, which makes it more ideal for travel. The pouch 10 is also designed to be flexible so as to avoid breakage during shipping unlike other storage containers. However, the pouch material must be strong enough to support the blade in the storage position in the event of axial force application such as the force created by opening the medicine cabinet door while the pouch is attached to the door.

The pouch 10 itself may be double-hulled to prevent leakage and corrosion. The pouch 10 is preferred over jars and glass for convenience of storage, reduction of shelf space, and stability in avoiding spills by knocking over a container. It also permits the blades to be stored on the inside of a medicine cabinet door, out of view from third parties, without reducing shelf space in the medicine cabinet.

The pouch 10 shape, when unfilled may be rectangular, preferably with the height 15 greater than the base 14. In one embodiment, the height 15 is approximately 5 inches and the base 14 is approximately 3.5 inches. The mouth 28 of the pouch 10 is of any dimension small enough to retain a razor blade, for a given pouch 10 depth. In a preferred embodiment, the pouch 10 is deep enough to securely contain most disposable and non-disposable razor sizes.

The pouch 10 may be entirely transparent or alternatively contain a window 26. The transparent package or window can be used to examine the appearance and amount of conditioner and oil solution 11 level, as well as the amount of trapped water.

As described herein, in a preferred embodiment, the user opens the top of the flexible pouch 10 such as by cutting it open with scissors, and attaches the pouch 10 to a wall or mirror using the support structure 24. After shaving, the razor is inserted into the pouch 10 and rests on the support heat seals 12, 20, or 22 inside the pouch 10. Water and debris settle to the bottom of the pouch 10 in the reservoir bottom 16. The razor remains in the pouch 10, submerged in the conditioner and oil solution 11, until it is reused. The conditioner and oil solution 11 acts to retard corrosion and oxidation of the razor blade and helps to moisturize the skin during subsequent use of the razor. By looking through the transparent window 26, the shaver will be alerted as to when the pouch 10 needs to be replaced or the fluid refilled.

While the invention is susceptible to various modifications and alternative forms, specific examples have been shown in the drawings and as described in detail. It should be understood, however, that the invention is not limited to the particular forms or methods disclosed. Rather, the invention is intended to cover all modifications and alternatives falling within the spirit and scope of the claims and their equivalents.

We claim:

1. A razor storage pouch comprising:

a) a pouch;

b) an oil and skin conditioner mixture contained in the pouch; and c) a reservoir bottom to provide support for a razor.

2. The device of claim 1 wherein heat seals are used to enclose the conditioner and oil mixture inside the pouch.

3. The device of claim 2 wherein the reservoir bottom is created from heat seals in the pouch.

4. The device of claim 3 wherein the heat seals are the shape of triangles.

5. The device of claim 3 wherein the heat seals are the shape of straight lines.

6. The device of claim 3 wherein the heat seals are the shape of half circles.

7. The device of claim 1 wherein the corrosion retarding oil and conditioner mixture is lighter than water.

8. The device of claim 1 wherein the pouch is transparent.

9. The device of claim 1 wherein the pouch has a transparent window.

10. The device of claim 1 wherein the pouch has an external connecting structure.

11. The device of claim 10 wherein the external connecting structure is an adhesive strip.

12. The device of claim 10 wherein the external connecting structure is selected from the group consisting of a magnetic strip, a hoop and loop connecting structure, or tape.

13. The device of claim 1 wherein the pouch is made from a flexible material.

14. The device of claim 1 wherein the pouch is made from double-hulled flexible material.

15. The device of claim 1 wherein the pouch is rectangular in shape.

16. The device of claim 15 wherein the height of the pouch is greater than the length of the pouch base.

17. A razor storage pouch comprising:

a) a pouch;

b) a reservoir bottom to provide support for a razor;

c) a corrosion retarding oil and conditioner mixture contained in the pouch; and d) an adhesive strip to provide an external connecting structure.

18. A method for storing razors after shaving comprising:

a) inserting a corrosion retarding oil and conditioner mixture in a flexible pouch;

b) attaching the flexible pouch with an external connecting structure to a wall or mirror; and c) inserting a razor into the flexible pouch after shaving.

* * * * *